US010118430B2

(12) United States Patent
O'Donnell et al.

(10) Patent No.: US 10,118,430 B2
(45) Date of Patent: Nov. 6, 2018

(54) IN-LINE TIE ARTICLES AND METHODS OF MANUFACTURE AND USE

(71) Applicant: Bedford Industries, Inc., Worthington, MN (US)

(72) Inventors: Colin O'Donnell, Bigelow, MN (US); David Schiller, Sioux Falls, SD (US); Mike Schultz, Worthington, MN (US); Axel Wass, Brewster, MN (US); Terry Langland, Worthington, MN (US); Joshua Platt, Bigelow, MN (US); Jay Milbrandt, Worthington, MN (US); Jeffrey Tschetter, Sioux Falls, SD (US)

(73) Assignee: Bedford Industries, Inc., Worthington, MN (US)

( * ) Notice: Subject to any disclaimer, the term of this patent is extended or adjusted under 35 U.S.C. 154(b) by 234 days.

(21) Appl. No.: 15/196,854

(22) Filed: Jun. 29, 2016

(65) Prior Publication Data

US 2016/0303888 A1 Oct. 20, 2016

Related U.S. Application Data

(63) Continuation of application No. 14/166,994, filed on Jan. 29, 2014, now Pat. No. 9,403,610.

(Continued)

(51) Int. Cl.

| | |
|---|---|
| ***B42D 25/22*** | (2014.01) |
| ***G09F 3/00*** | (2006.01) |
| ***G09F 3/14*** | (2006.01) |
| ***B65B 27/10*** | (2006.01) |
| ***B65B 61/02*** | (2006.01) |
| ***G09F 3/06*** | (2006.01) |
| ***B42D 25/00*** | (2014.01) |

(52) U.S. Cl.

CPC ..... *B42D 25/22* (2014.10); *B42D 25/00* (2014.10); *B65B 27/10* (2013.01); *B65B 61/025* (2013.01);

(Continued)

(58) Field of Classification Search

CPC ..... B42D 25/00; B42D 25/22; B65B 27/10; B65B 35/00; B65B 61/00; G09F 3/06; G09F 3/14; G09F 3/0295; G09F 3/0291

(Continued)

(56) References Cited

U.S. PATENT DOCUMENTS

| | | | |
|---|---|---|---|
| 2,257,505 | A | 9/1941 | Lichter |
| 2,850,820 | A | 9/1958 | Lersch |

(Continued)

FOREIGN PATENT DOCUMENTS

| | | | | |
|---|---|---|---|---|
| JP | 53003483 | A | * | 1/1978 |
| KR | 20120002709 | A | | 1/2012 |
| KR | 1020120002709 | A | * | 1/2012 |

OTHER PUBLICATIONS

Further Examination Report dated May 30, 2017 for New Zealand Application No. 710364.

(Continued)

*Primary Examiner* — Philip C Tucker
*Assistant Examiner* — Vicki Wu
(74) *Attorney, Agent, or Firm* — Mai-Tram D. Lauer; Westman, Champlin & Koehler, P.A.

(57) ABSTRACT

A tie article that includes an attachment portion and a bib portion, where the bib portion includes at least one arm segment and at least one closure device (e.g., a retention wire, tin tie, clasp tie, and the like), where the attachment portion and the bib portion are integrally fabricated from a printed sheet having a first surface and a polymeric film adhered to the first surface of the printed sheet such that the closure device(s) is disposed between the first surface of the printed sheet and the polymeric film at the attachment portion. Multiple tie articles may be manufactured with an in-line process.

20 Claims, 10 Drawing Sheets

Related U.S. Application Data

(60) Provisional application No. 61/760,838, filed on Feb. 5, 2013, provisional application No. 61/784,301, filed on Mar. 14, 2013.

(52) U.S. Cl.
CPC ..... *G09F 3/0295* (2013.01); *G09F 3/06* (2013.01); *G09F 3/14* (2013.01)

(58) Field of Classification Search
USPC ..... 156/244.19
See application file for complete search history.

(56) References Cited

U.S. PATENT DOCUMENTS 2,973,597 A * 3/1961 Powell ..... G09F 3/04 24/30.5 R
2,973,798 A * 3/1961 Powell ..... B31D 1/024 100/171
3,808,646 A 5/1974 Brumlik
3,973,294 A * 8/1976 Pfizenmaier ..... B65D 33/30 229/87.09
5,005,264 A 4/1991 Breen
5,732,495 A * 3/1998 Lowe ..... G09F 3/14 24/30.5 T
5,961,434 A * 10/1999 Helseth ..... A47F 13/08 156/296
7,281,345 B2 * 10/2007 Ludlow ..... G09F 3/14 40/637
9,796,514 B2 10/2017 Buselli
2008/0136887 A1 * 6/2008 Schmitt ..... B42D 25/00 347/106

OTHER PUBLICATIONS

Examination Report No. 1 dated Feb. 17, 2017 for Australian Application No. 2014215622.
New Zealand Examination Report dated Nov. 18, 2016 for corresponding New Zealand Application No. 710364.
European Communication dated Feb. 6, 2018 for European Application No. 14706167.5.

* cited by examiner

IN-LINE TIE ARTICLES AND METHODS OF MANUFACTURE AND USE

CROSS-REFERENCE TO RELATED APPLICATIONS

This application is a continuation of pending U.S. patent application Ser. No. 14/166,994, filed Jan. 29, 2014, which claims priority to and the benefit of U.S. Provisional Patent Application No. 61/760,838, filed on Feb. 5, 2013; and to U.S. Provisional Patent Application No. 61/784,301, filed on Mar. 14, 2013; the disclosures of each of which are incorporated by reference.

BACKGROUND

The present disclosure is directed to articles for banding and tagging merchandise, and more particularly to tie articles bearing printed information formed with retention wires for banding merchandise.

Merchandise of many different types is banded in one way or another for packaging or preparing the merchandise for movement in channels toward the ultimate presentation and marketing to the consumer. For example, a twist tie may be placed about the mouth of a bag or about a box of merchandise or about multiple boxes. The twist tie may also be placed directly about the merchandise itself, such as about a grouping of agricultural produce or about a single item of merchandise (e.g., a rolled or folded newspaper).

Labeling or marking of merchandise with printed matter is also often desirable to provide information to various entities in the production and marketing channels as well as to the ultimate consumer. The printed matter may provide information regarding merchandise identification and price and may take the form of, for example, machine readable or scannable material (such as codes comprised of bars or characters) and human readable material (such as characters and graphical or pictorial matter).

SUMMARY

An aspect of the present disclosure is directed to a tie article that includes an attachment portion and a bib portion. The attachment portion includes a connection segment, at least one arm segment extending from the connection segment, and at least one closure device (e.g., a retention wire, tin tie, clip tie, and the like) extending along the connection segment and the arm segment(s). The bib portion extends from the connection segment of the attachment portion, where the attachment portion and the bib portion are integrally fabricated from a printed sheet having a first surface and a polymeric film adhered to the first surface of the printed sheet such that the closure device(s)(s) is disposed between the first surface of the printed sheet and the polymeric film at the attachment portion.

Another aspect of the present disclosure is directed to an in-line process for manufacturing tie articles. The in-line processes includes feeding a printed sheet of a paper-based material to a nip roller, where the printed sheet comprises printed information, feeding a plurality of closure devices (e.g., retention wires, tin ties, clip ties, and the like) to the nip roller with the fed printed sheet, and feeding an extruded polymeric material to the nip roller with the fed printed sheet and the fed closure devices. The process also includes forming a tie article sheet from the fed printed sheet, the fed closure devices, and the fed polymeric material such that the closure devices are encased between the printed sheet and the polymeric material. The process also includes cutting the tie article sheet into a plurality of tie articles having attachment portions with the closure devices and bib portions extending from the attachment portions and having the printed information, where at least a portion of the plurality of tie articles remain at least partially connected to each other at the cut tie article sheet.

Another aspect of the present disclosure is directed to a method for labeling an item. The method includes providing a tie article having an attachment portion and a bib portion extending from the attachment portion and having printed information. The attachment portion and the bib portion are integrally connected with a printed sheet, where the attachment portion also includes a polymeric film adhered to the printed sheet with a closure device (e.g., a retention wire, tin tie, clip tie, and the like) encased therebetween, and where the attachment portion further includes at least one arm segment. The method also includes folding the arm segment(s) of the attachment portion around at least a portion of the item to secure the item against the attachment portion, and such that the bib portion extends from the secured attachment portion to display the printed information.

DEFINITIONS

Unless otherwise specified, the following terms as used herein have the meanings provided below:

The terms "tie portion" and "tie article" are not intended to limit the use or function of the tie articles of the present disclosure to twist-tie or other tying arrangements, and the tie portions may be used to attach the tie articles to items in a variety of manners, such as with the clasp engagements, as discussed below.

The term "providing", such as for "providing an attachment article", when recited in the claims, is not intended to require any particular delivery or receipt of the provided item. Rather, the term "providing" is merely used to recite items that will be referred to in subsequent elements of the claim(s), for purposes of clarity and ease of readability.

The terms "about" and "substantially" are used herein with respect to measurable values and ranges due to expected variations known to those skilled in the art (e.g., limitations and variabilities in measurements).

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure is directed to tie articles, such as bib ties and flag ties, that may be manufactured in a continuous, in-line process, which reduces manufacturing costs and time, and which desirably produces tie articles with good durability. As discussed below, the tie article of the present disclosure includes a bib portion and a tie or attachment portion, and may be used in a variety of industrial, commercial, and residential applications. For instance, the tie or attachment portion may be used to attach the tie article to an item, to bundle items together (e.g., agricultural produce, closable packages, cables, writing utensils, eating utensils, and the like), and/or to hold packages or articles closed (e.g., hold bread bags closed or hold rolled papers closed).

Figure 1:
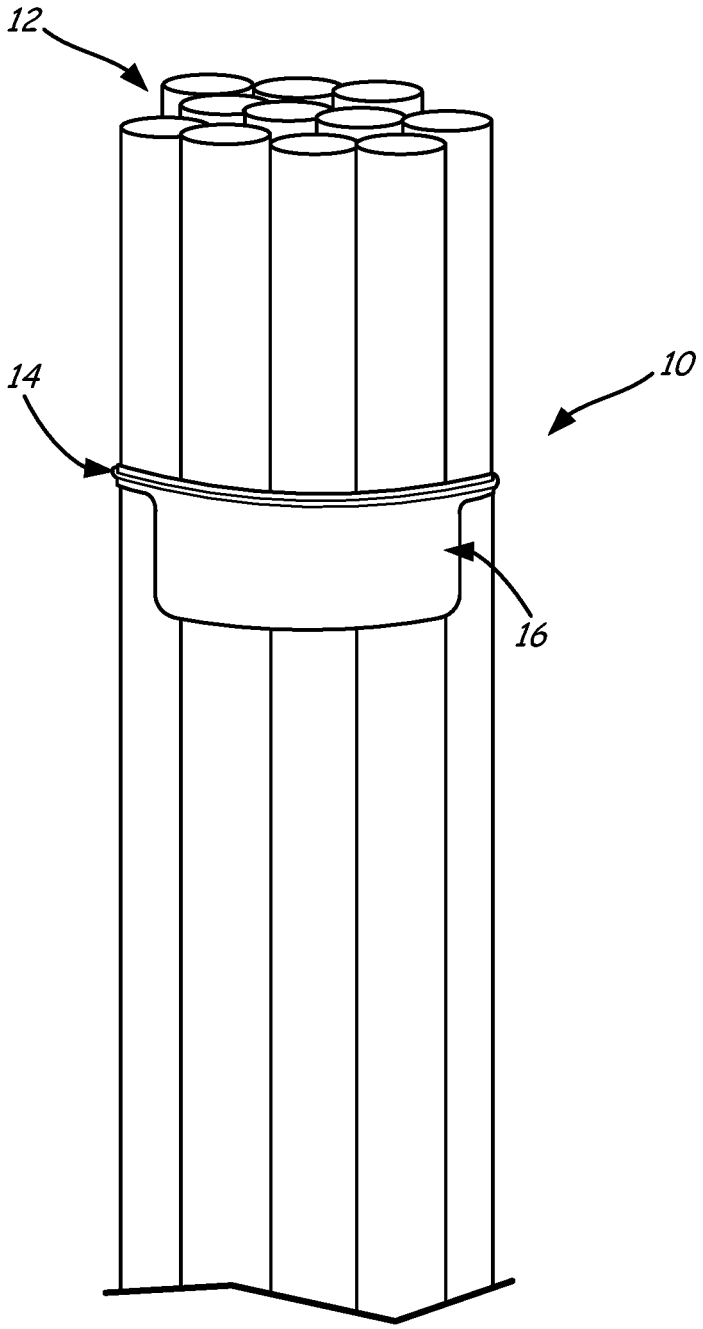
FIG. 1 is a front perspective view of a tie article of the present disclosure attached to a banded group of items.

Once the tie or attachment portion is attached to the item, the bib portion may then prominently display information, such as textual, graphical, colored, machine readable information (e.g., bar codes, quick response codes, RFID tags), internet addresses, about the attached or bundled items. For example, FIG. 1 illustrates tie article 10 in use with bundled cables 12, where tie article 10 includes tie portion 14 and bib portion 16. As shown, tie portion 14 is secured around cables 12 to bundle them together, and to secure tie article 10 to them. While illustrated in use with cables 12, tie article 10 may alternatively be used to bundle a variety of different items, as mentioned above.

When attached to cables 12, bib portion 16 is suspended from tie portion 14, and may include readable or otherwise viewable information about cables 12, such as the produce type, UPC codes, brand information, storage and use instructions, producer information, and the like. Thus, tie article 10 provides a convenient and effective mechanism for bundling cables 12 or other items together, while also prominently displaying information about cables 12 or the other items. Furthermore, as discussed below, tie portion 14 and bib portion 16 may be integrally formed together in a continuous, in-line manufacturing process, which preferably produces multiple tie articles 10 in sheet and/or roll form.

Figure 2:
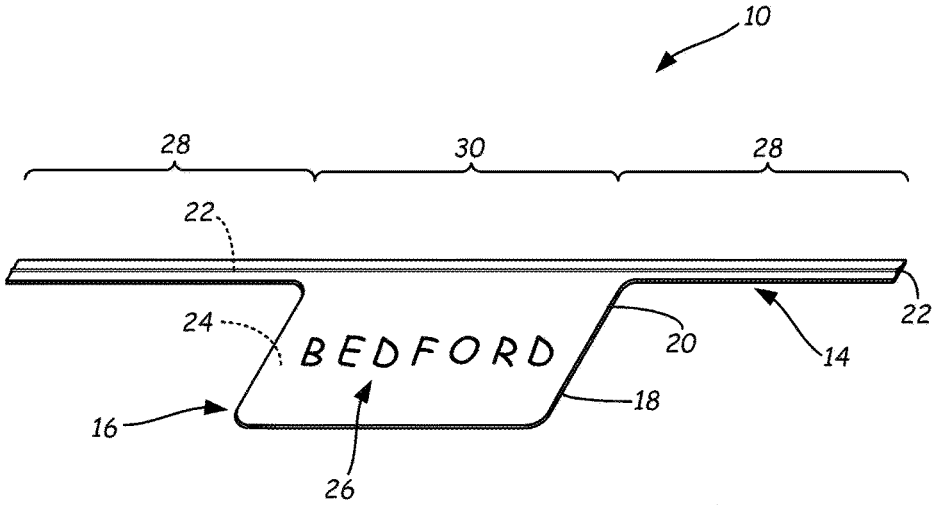
FIG. 2 is a top perspective view of the tie article.
Figure 3:
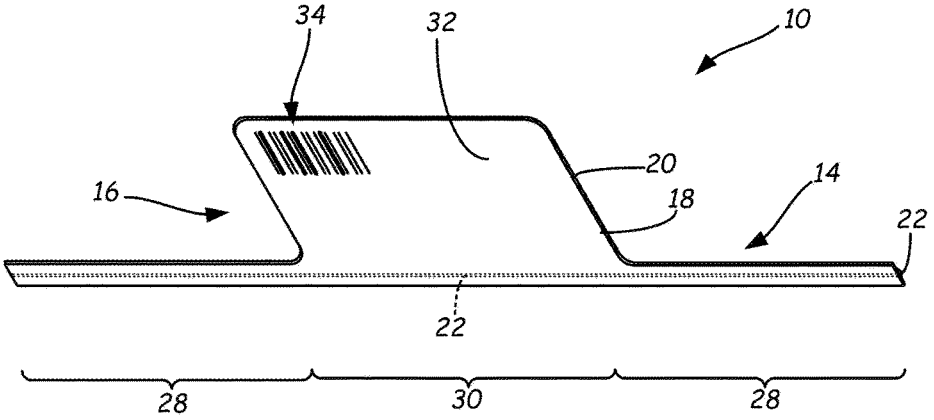
FIG. 3 is a bottom perspective view of the tie article.
Figure 4:
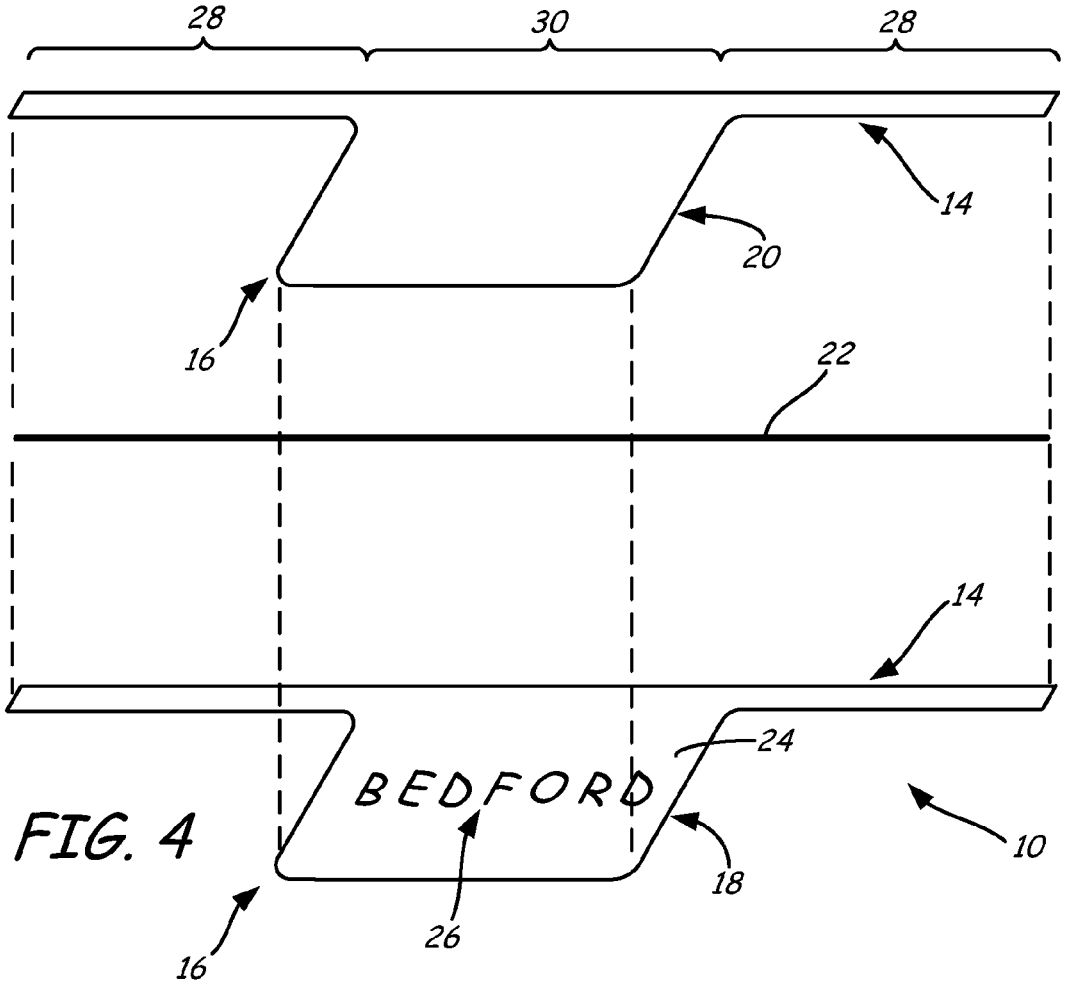
FIG. 4 is an exploded top perspective view of the tie article.

FIGS. 2-4 illustrate a first example embodiment for tie article 10. As shown in FIG. 2, prior to being secured to an item (e.g., cables 12), tie portion 14 may be provided in a flat, non-bent state (as shown) or in a partially-bent state (e.g., if provided in a roll form). As further shown, tie portion 14 integrally extends into bib portion 16, where tie portion 14 and bib portion 16 structurally include printed sheet 18, front film 20, and retention wire 22 (or other closure device, such as a tin tie, clip tie, and the like). Printed sheet 18 and front film 20 are secured together at both tie portion 14 and bib portion 16, where retention wire 22 is secured therebetween along tie portion 14. As such, tie portion 14 may function as a twist tie or other attachment mechanism to secure tie article 10 to items, to bundle the items together, and/or to hold packages or other articles closed.

Printed sheet 18 is desirably produced from a printable material, such as one or more paper-based materials and/or polymeric materials to present information (e.g., textual, graphical, colored, and/or machine readable information). As discussed below, when manufacturing tie article 10, printed sheet 18 is desirably provided as a pre-formed and pre-printed sheet that may be fed into a continuous, in-line process.

Front film 20 is desirably produced from a clear polymeric material that exhibits good interlayer bonding to printed sheet 18. This allows information presented on a front surface 24 of printed sheet 18, such as indicia 26, to be visible through front film 20. The good interlayer bonding also secures retention wire 22 between printed sheet 18 and front film 20 at tie portion 14.

The polymeric material of front film 20 also desirably provides durability to tie article 10 and protects printed sheet 18. For example, in embodiments in which printed sheet 18 is produced from printable paper, front film 20 may structurally reinforce the paper at tie portion 14 and bib portion 16, thereby reducing the risk of tearing tie article 10 during use. Examples of suitable polymeric materials for front film 20 include extrudable polymeric materials, such as polyolefins (e.g., low-density polyethylene, high-density polyethylene, and combinations thereof).

Retention wire 22 is a metallic or polymeric wire that desirably provides good dead-fold properties, as well as good break resistance. For example, in one embodiment, retention wire 22 is a metallic-wire core of a twist tie (e.g., a steel wire). However, metal-wire twist ties may be undesirable for use in some applications. For example, when food is commercially packaged for distribution to the public, it is desirable for the packaging to allow inspection of packaged food for contamination by foreign objects. One common method of inspecting food products involves the use of metal detectors to confirm that no metal scrap or shards have inadvertently been incorporated in the food product during production or packaging of the food product.

Tie articles with metal retention wires, when attached to food articles, preclude such use of a metal detector, since each food article that is attached to the tie article would typically generate a response by the metal detector indicating the presence of metal in the food package. Thus, rather than simply detecting the presence of any undesired metal in the packaged food, the metal detector would also indicate, for each package, the presence of the metal wire retention wire on the tie article.

Accordingly, in other embodiments, retention wire 22 is a polymeric wire, such as a single component wire or a multiple component wire. Suitable polymeric materials for retention wire 18 include polyethylenes (e.g., high-density polyethylenes), and those disclosed in U.S. Pat. Nos. 6,372,068, 6,673,413 and 7,011,879. In embodiments in which the polymer material is a high-density polyethylene, the high-density polyethylene desirably has a weight-average molecular weight ranging from about 130,000 to about 150,000. The high density polyethylene also desirably has a density of at least about 0.94 grams/cubic-centimeter, as measured pursuant to ASTM D792-08.

In some embodiments, the material of retention wire 22 may also include additional additives, such as colorants, fillers, dead-fold modifiers, biodegradable additives (e.g., oxo-biodegradable additives), toughness modifiers, bond promoters, ultraviolet-stabilizers, and the like. In these embodiments, examples of suitable concentrations of the additives in the material range from about 0.01% by weight to about 10% by weight, based on an entire weight of the material. In one embodiment, suitable concentrations of the additives in the material range from about 0.05% by weight to about 5% by weight, based on an entire weight of the material. The polymeric materials discussed above accordingly constitute the remainder of the material for retention wire 22.

While illustrated with a single retention wire 22, in other embodiments, tie portion 12 may include other polymeric and/or metallic closure devices, such as tin ties, clip ties, and the like. In these embodiments, the closure device also desirably provides good dead-fold properties, as well as good break resistance.

At tie portion 14, printed sheet 18, front film 20, and retention wire 22 define a pair of arm segments 28 extending in opposing lateral directions from connection or mid-segment 30. Arm segments 28 may function as twist-tie arms, which may be manipulated (e.g., bent and twisted) to secure tie article 10 to items. Printed sheet 18 and front film 20 extend into bib portion 16 at mid-segment 30, allowing bib portion 16 to be suspended from tie portion 14 when tie portion 14 is attached or bundled to items to display indicia 26.

Examples of suitable thicknesses for tie portion 14 (outside of the location of retention wire 22) and for bib portion 16 range from about 0.003 inches to about 0.01 inches, where the relative thicknesses of printed sheet 18 and front film 20 may vary depending on the particular materials used for each. For example, in embodiments in which printed sheet 18 is produced from a stiffer and stronger card material, front film 20 may be thinner since front printed sheet 18 requires less structural reinforcement. However, in other embodiments in which printed sheet 18 is produced from a printable thinner and weaker material (e.g., paper), front film 20 is desirably thicker to structurally reinforce printed sheet 18.

At the location of retention wire 22, the thickness of tie portion 14 is increased to account for the dimensions of retention wire 22. For example, for a retention wire 22 having a diameter or other cross-sectional thickness of about 0.017 inches, examples of suitable thicknesses for tie portion 14 at the location of retention wire 22 range from about 0.02 inches to about 0.03 inches.

As shown in FIG. 3, printed sheet 18 also includes rear surface 32, which may also include printed information, such as bar code 34 or other textual, graphical, colored, machine readable information, and/or internet addresses. Because front film 20 is disposed over front surface 24 of printed sheet 18, in the shown embodiment, rear surface 32 of printed sheet 18 may be directly exposed for displaying bar code 34 or other information.

FIG. 4 further illustrates the relative arrangements of printed sheet 18, front film 20, and retention wire 22. As can be seen, front surface 24 of printed sheet 18 is disposed below front film 20 when printed sheet 18 and front film 20 are bonded together, allowing indicia 26 to be visible through the clear polymeric material of front film 20. In alternative embodiments, printed sheet 18 may function as the front side of tie article 10, and film 20 may function as the rear side of tie article 10 (i.e., film 20 is bonded to rear surface 32 of sheet 18). This may depend on which side of tie article 10 the user or manufacturer intends to display when attached to one or more items.

As further shown, retention wire 22 (or other closure device) may be free of any additional paper wings that are otherwise associated with twist ties. This is because printed sheet 18 and front film 20 themselves function as the twist tie wings at tie portion 14. This precludes the need for an additional manufacturing step to produce a twist tie prior to assembling the twist tie with a bib portion in a fold-over manner. Instead, tie article 10 may be manufactured with only the components for printed sheet 18, front film 20, and retention wire 22, if desired, thereby reducing material costs and the number of manufacturing steps.

Figure 5:
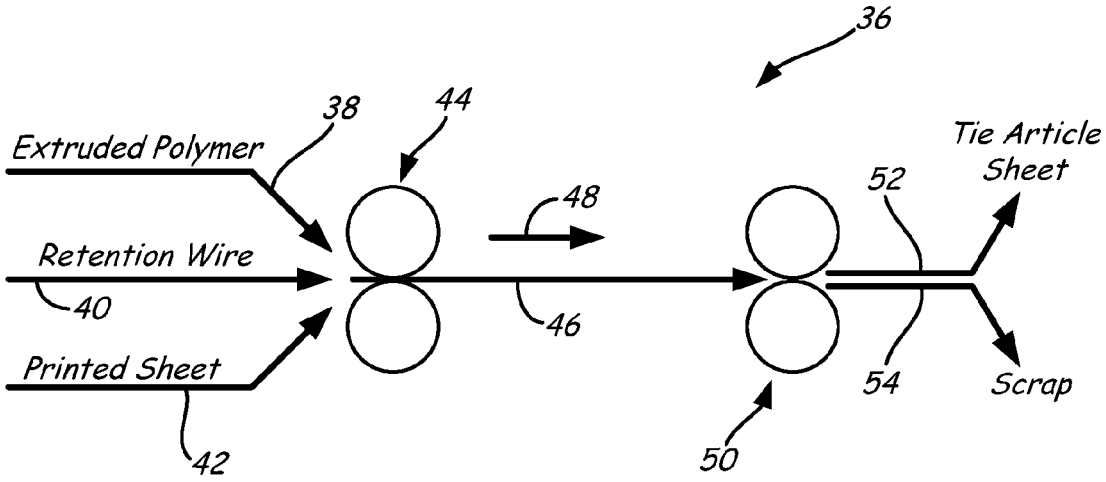
FIG. 5 is a schematic illustration of a process system for manufacturing the tie article.

FIG. 5 is a schematic illustration of an example process system 36 for manufacturing multiple tie articles 10 in a sheet or roll form using a continuous, in-line process. As shown, process system 36 includes extruded polymer inlet line 38, wire inlet line 40, and sheet inlet line 42. Extruded polymer inlet line 38 is an extrusion line (e.g., a twin-screw extruder) configured to melt and extrude the polymeric material for front film 20. Wire inlet line 40 is configured to relay one or more continuous strands of retention wire 22 (or other closure device) from supply sources (e.g., spools of retention wires 22 or manufacturing lines for retention wires 22). Finally, sheet inlet line 42 is configured to relay pre-printed sheets for printed sheet 18.

Polymer inlet line 38, wire inlet line 40, and sheet inlet line 42 desirably converge at nip rollers 44, which may compress and cool the received materials to produce a continuous web 46 of the laminated layers. Web 46 moves in the direction of arrow 48 and is cut at die cutter 50 into the multiple, separable tie articles 10. For example, die cutter 50 may partially cut and/or perforate web 46, allowing web 46 to maintain a continuous sheet of multiple, separable tie articles 10 that can exit process system 36 via exit line 52. Resulting scrap pieces may drop out of process system 36 via scrap line 54, where the scrap pieces may then be collected and recycled. The resulting continuous sheet of tie articles 10 from exit line 52 may then be stacked, folded, rolled into a roll form, or otherwise made available for subsequent consumer use.

In an alternative embodiment, the pre-printed sheet entering via sheet inlet line 42 may be pre-cut (e.g., die cut) prior to reaching nip rollers 44. In this embodiment, the lamination of the polymer to form front film 20 may form a window over the pre-cut sheet, which can be subsequently separated (or cut, if desired).

Figure 6:
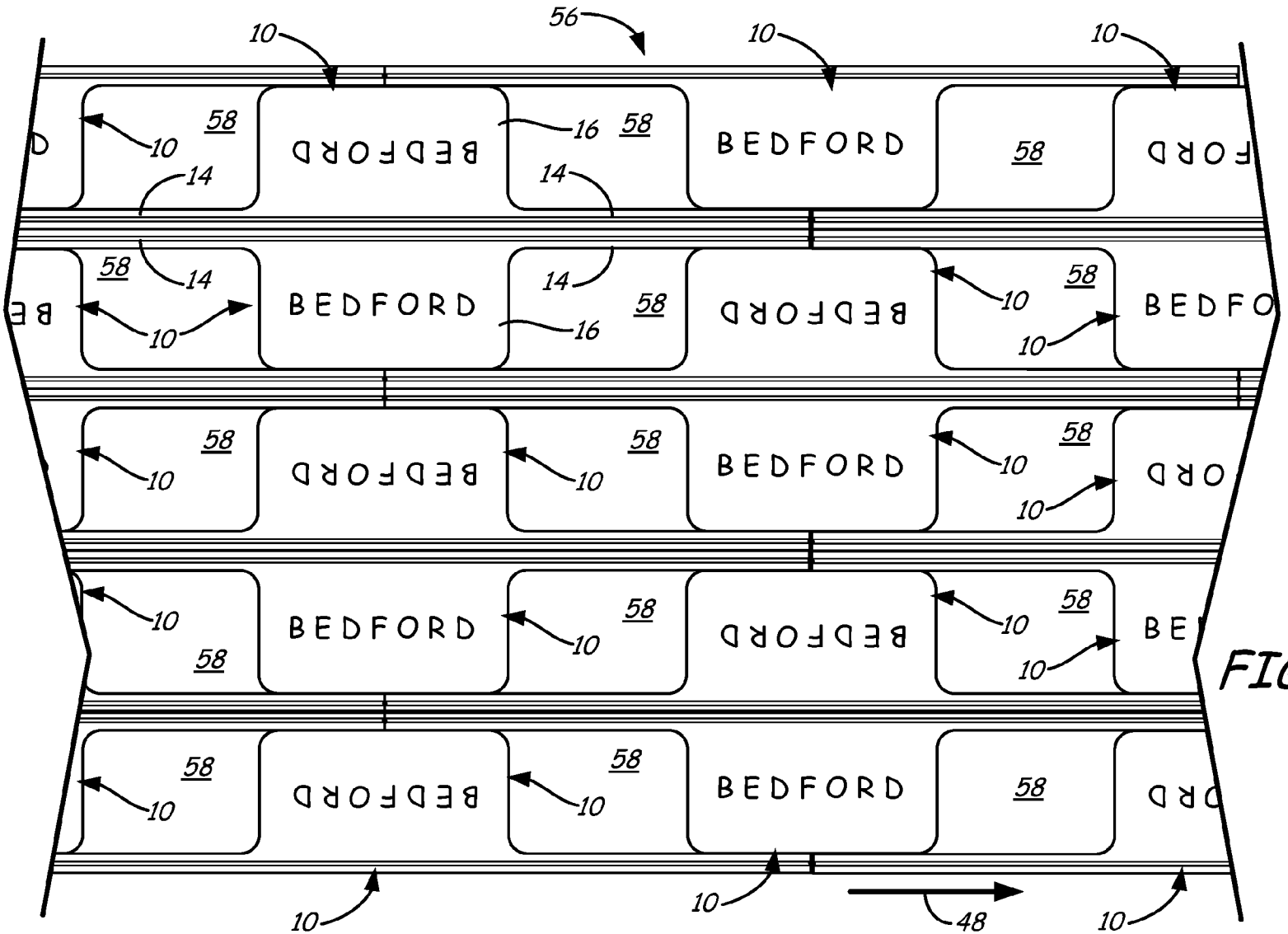
FIG. 6 is a top view of a continuous sheet of multiple tie articles.

FIG. 6 illustrates an example continuous sheet 56 of multiple tie articles 10 after exiting process system 36 via exit line 52. As shown, continuous sheet 56 may include multiple tie articles 10 arranged in a staggered back-to-back arrangement to maximize the number of tie articles 10 per square area of sheet 56. In particular, this staggered back-to-back arrangement provides repeating patterns of ten tie articles 10, with two staggered sets of five back-to-back tie articles 10.

To maintain the sheet-like character of sheet 56, the individual tie articles 10 desirably remain at least partially connected to each other. For example, in some embodiments, the tie articles 10 may be cut around bib portions 16, where the segments of sheet 56 between each pair of bib portions 16 (referred to as regions 58) may be fully cut out to provide the scrap at scrap line 54 (shown above in FIG. 5). Alternatively, regions 58 may remain connected to sheet 56 and partially separated from the bib portions 16 via perforated lines, allowing regions 58 to be readily separated by consumers when needed.

Furthermore, the ends of the retention wires 22 (or other closure devices) are desirably fully cut to assist in the ease of separating the individual tie articles 10. A variety of different cut patterns may be used to retain sheet 56 in a sheet-like form, while also allowing each individual tie article 10 to be separated without requiring undue force or separate cutting utensils. As mentioned above, upon exiting process system 36, sheet 56 may be stacked, folded, rolled into a roll form, or otherwise made available for transporting, storing, and using tie articles 10.

Accordingly, during subsequent consumer use, the consumer may obtain a sheet or roll of sheet 56, separate the desired number of tie articles 10 (manually or with an automated system), and attach them to one or more items with tie portions 14 (again, manually or with an automated system). For example, tie portion 14 of a tie article 10 may be attached to a single item, and the corresponding bib portion 14 may then display information for the given item. Alternatively, tie portion 14 may be bound around multiple items to bundle the items together. In this situation, the corresponding bib portion 14 may also display information for the given bundled items. Furthermore, tie portion 14 may be used hold a package closed, such as bread bag twist tie, where the corresponding bib portion 14 may display information for the given package or goods within the package. Additionally, tie portion 14 may be used hold an article closed, such as rolled paper (e.g., a rolled map), where the corresponding bib portion 14 may display information for the given article.

Figure 7:
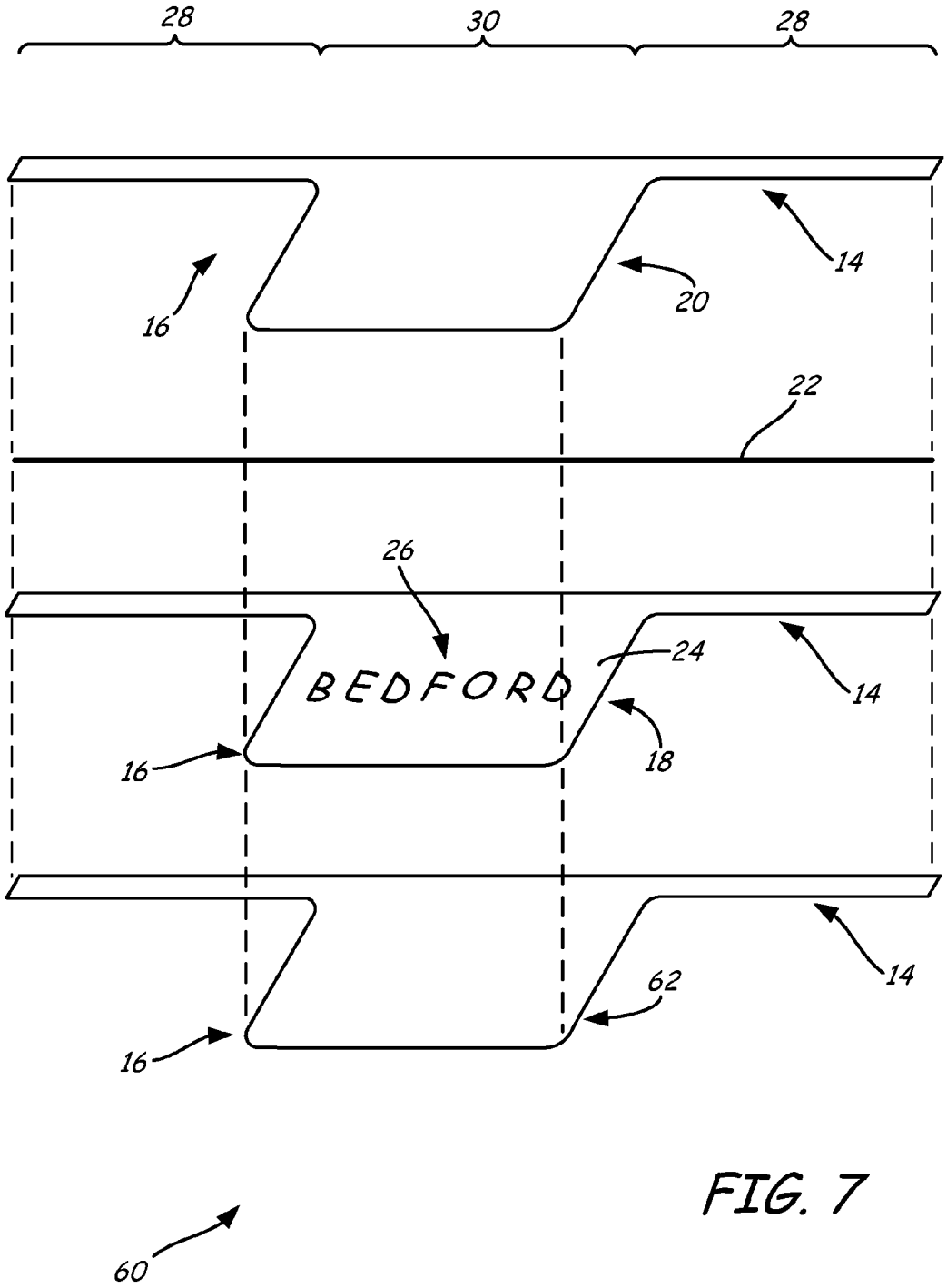
FIG. 7 is an exploded top perspective view of a first alternative tie article of the present disclosure, which includes a rear film.
Figure 8:
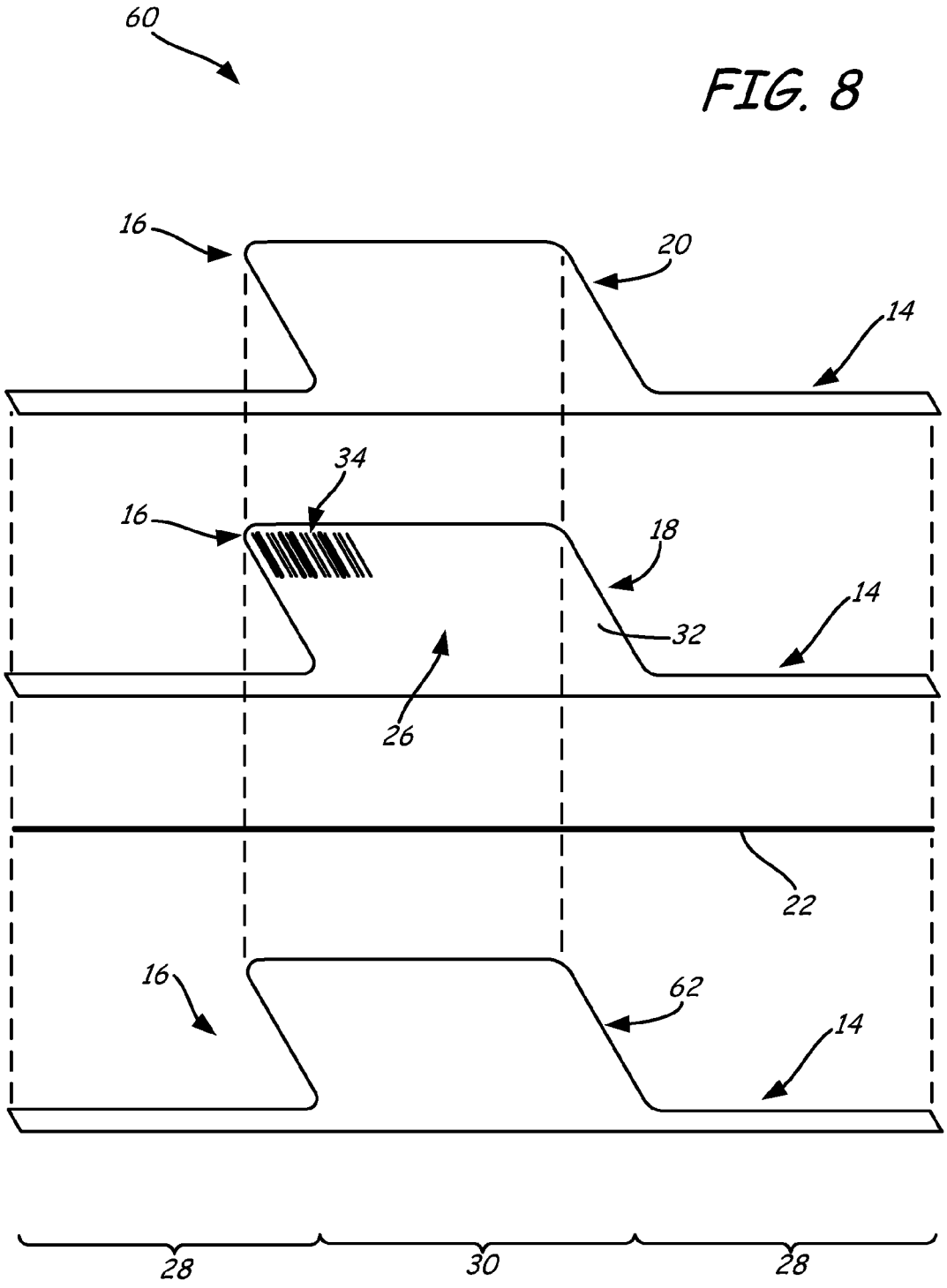
FIG. 8 is an exploded bottom perspective view of a first alternative tie article.

FIGS. 7 and 8 illustrate a first alternative embodiment to tie article 10, referred to as tie article 60. Tie article 60 is similar to tie article 10, but further includes a rear film 62 bonded to rear surface 32 of printed sheet 18. Suitable materials for rear film 62 include those discussed above for front film 20. As such, rear film 62 is also desirably clear, allowing information on rear surface 32, such as bar code 34 (shown in FIG. 8), to be visible through rear film 62. Rear film 62 may be used to further reinforce printed sheet 18, where front film 20 and rear film 62 may collectively encase printed sheet 18, thereby protecting printed sheet 18 from adverse environmental conditions (e.g., moisture).

Multiple tie articles 60 may also be manufactured in sheet form as discussed above for tie articles 10 and sheet 56 (shown above in FIG. 6). In particular, process system 36 (shown above in FIG. 5) may be modified to include a second extruded polymer inlet line, similar to inlet line 38, on the opposing side of sheet inlet line 42 from wire inlet line 40. This allows process system 36 to produce sheets and/or rolls of multiple tie articles 60 in a similar manner to that as discussed above for the sheets and rolls of multiple tie articles 10.

Figure 9:
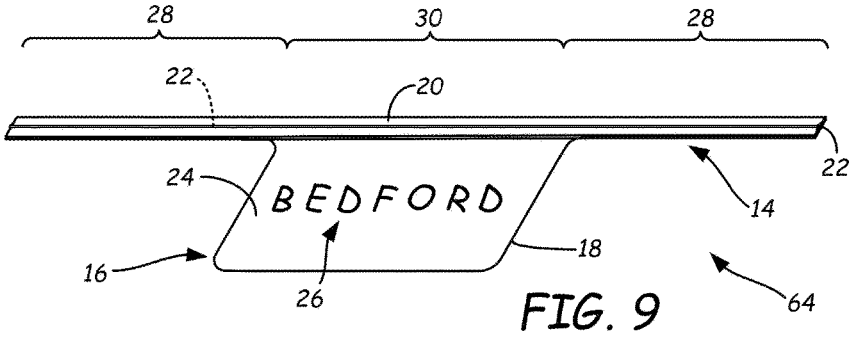
FIG. 9 is an top perspective view of a second alternative tie article of the present disclosure, which includes a front film with a reduced coverage area.
Figure 10:
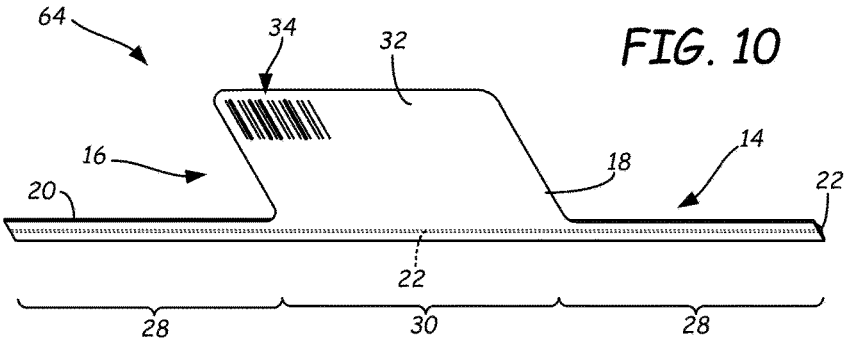
FIG. 10 is an bottom perspective view of a second alternative tie article.
Figure 11:
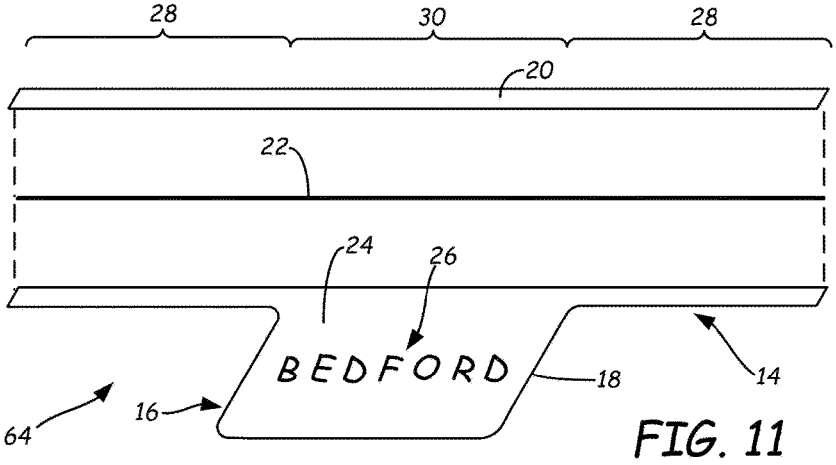
FIG. 11 is an exploded top perspective view of the second alternative tie article.

FIGS. 9-11 illustrate another alternative embodiment to tie articles 10 and 60, referred to as tie article 64. As shown in this embodiment, front film 20 of tie article 64 only extends over printed sheet 18 at tie portion 14. Accordingly, front surface 24 of printed sheet 18 at bib portion 16 may be exposed without any film overcoat. This embodiment is suitable, for example, when printed sheet 18 is produced from a durable paper-based material that does not otherwise require structural reinforcement. Nonetheless, laminating front film 20 over printed sheet 18 at tie portion 14 retains retention wire 22 (or other closure device) therebetween, allowing tie article 64 to also be manufactured in a continuous, in-line process as discussed above for tie articles 10 and sheet 56 (shown above in FIG. 6). However, in this embodiment, sheet 18 may be post-printed (e.g., after nip rollers 44 of process system 36), if desired.

In alternative embodiments, front film 20 may extend partially into bib portion 16 to partially reinforce printed sheet 18. As such, front film 20 may cover any desired area of bib portion 16. Moreover, in alternative embodiments, printed sheet 18 may function as the front side of tie article 10, and film 20 may function as the rear side of tie article 10. In other words, film 20 and retention wire 22 (or other closure device) may be secured to the rear side of tie article 64, if desired. This may depend on which side of tie article 10 the user or manufacturer intends to display when attached to one or more items.

Figure 12:
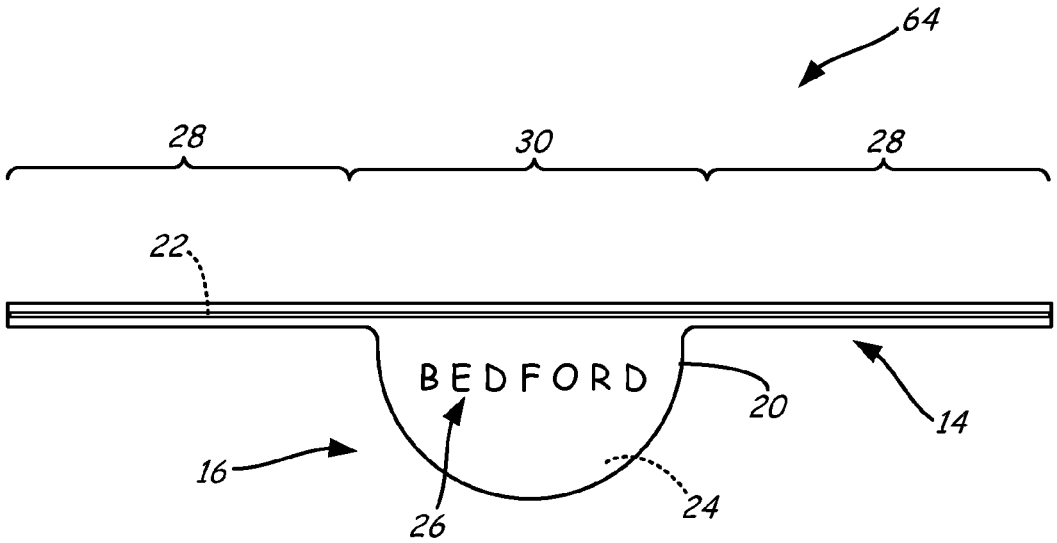
FIG. 12 is a top view of a third alternative tie article of the present disclosure, illustrating a half-circle bib portion.
Figure 13:
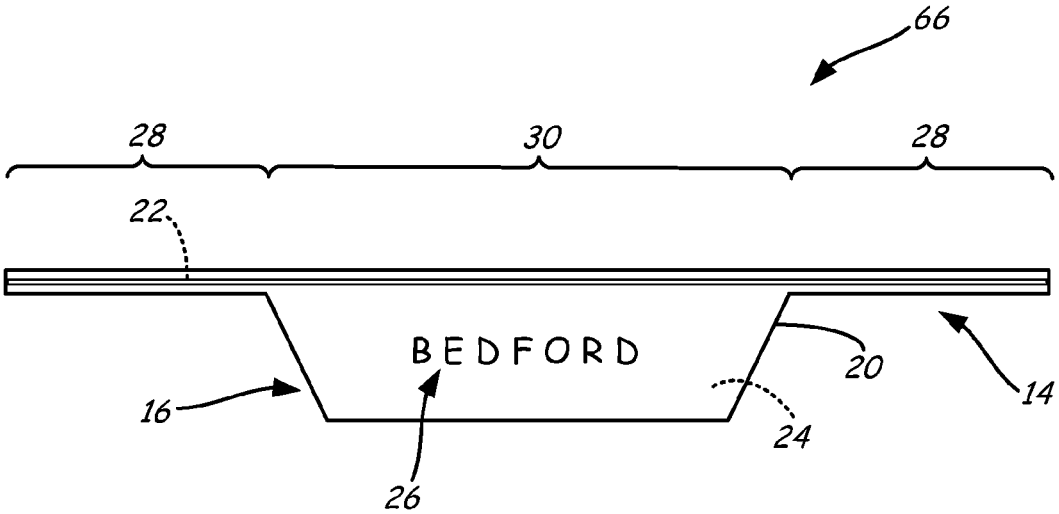
FIG. 13 is a top view of a fourth alternative tie article of the present disclosure, illustrating a trapezoidal bib portion.

In the above-discussed embodiments of the tie articles of the present disclosure (e.g., tie articles 10, 60, and 64), the bib portions 16 each included a substantially rectangular geometry. However, the tie articles of the present disclosure may have bib portions with any desired geometry. For example, as shown in FIG. 12, tie article 66 may include a bib portion 16 having a half-circle geometry. Alternatively, as shown in FIG. 13, tie article 68 may include a bib portion 16 having a trapezoidal geometry.

The particular geometry for bib portion 16 may be generated with die cutter 50 of process system 36 (shown above in FIG. 5), where the cutout regions 58 of sheet 56 (shown in FIG. 6) will have geometries that are reciprocal matches to the geometries of bib portions 16. As can be appreciated, the use of cutout regions 58 in this manner allows a single process system 36 to be used to manufacture tie articles of the present disclosure having a variety of customized bib portions, where the only modification to process system 36 is to interchange the cutting die 50.

Figure 14:
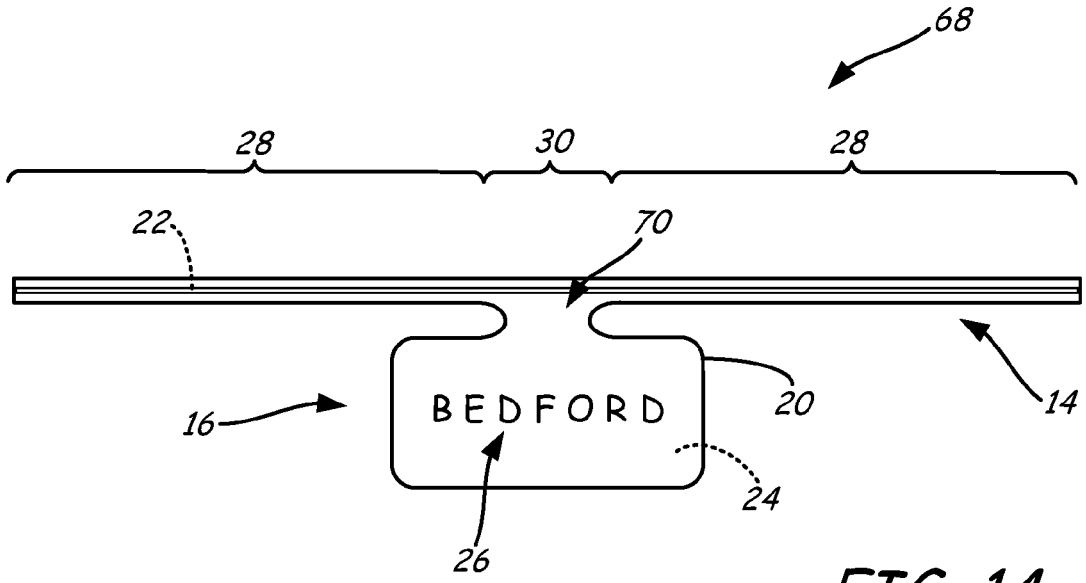
FIG. 14 is a top view of a fifth alternative tie article of the present disclosure, illustrating a necked-down bib portion.

FIG. 14 illustrates tie article 68, which is another alternative to tie articles 10, 60, 64, and 66 (or a tie article having any desired geometry for bib portion 16). In this embodiment, tie portion 14 and bib portion 16 are integrally connected at a neck-down region 70. The use of neck-down region 70 increases the lengths of arm segments 28, while also allowing bib portion 16 to retain any desired geometry, as discussed above. Furthermore, this arrangement reduces the extent that bib portion 16 will bend with tie portion 14 when arm segments 28 are bent and tied together around items, allowing bib portion 16 to remain in a desired display orientation during use.

Figure 15:
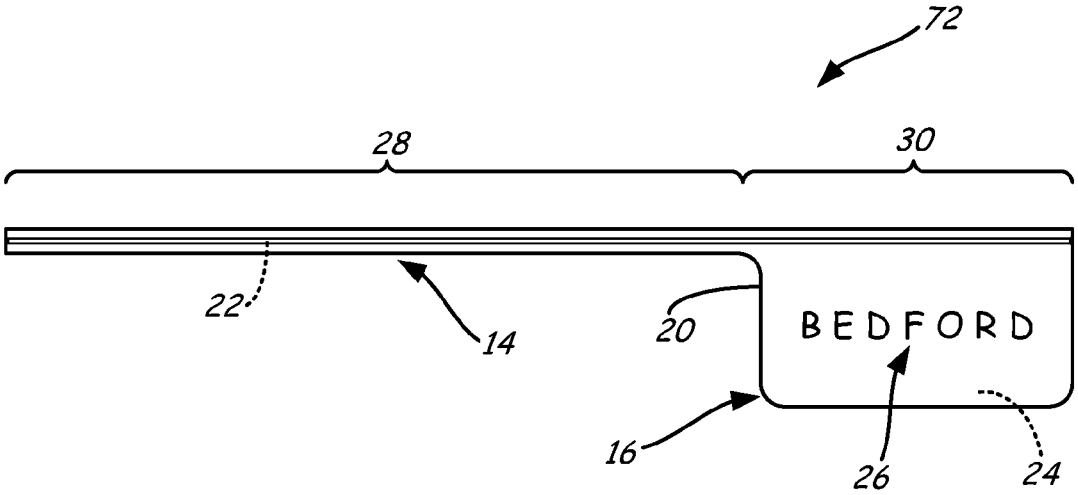
FIG. 15 is a top view of a sixth alternative tie article of the present disclosure, illustrating an off-centered bib portion.

FIG. 15 illustrates tie article 72, which is yet another alternative to tie articles 10, 60, 64, 66, and 68 (or a tie article having any desired geometry for bib portion 16). In this embodiment, bib portion 16 is disposed at a lateral end of tie article 72, providing a single arm segment 28. In this manner, tie article 72 may function as a flag tie, where a single arm segment 28 is used to attach tie article 72 to items. As can be appreciated, bib portion 16 may alternatively be positioned at any centered or off-centered location relative to the length of tie portion 14, as individual needs may require.

Figure 16:
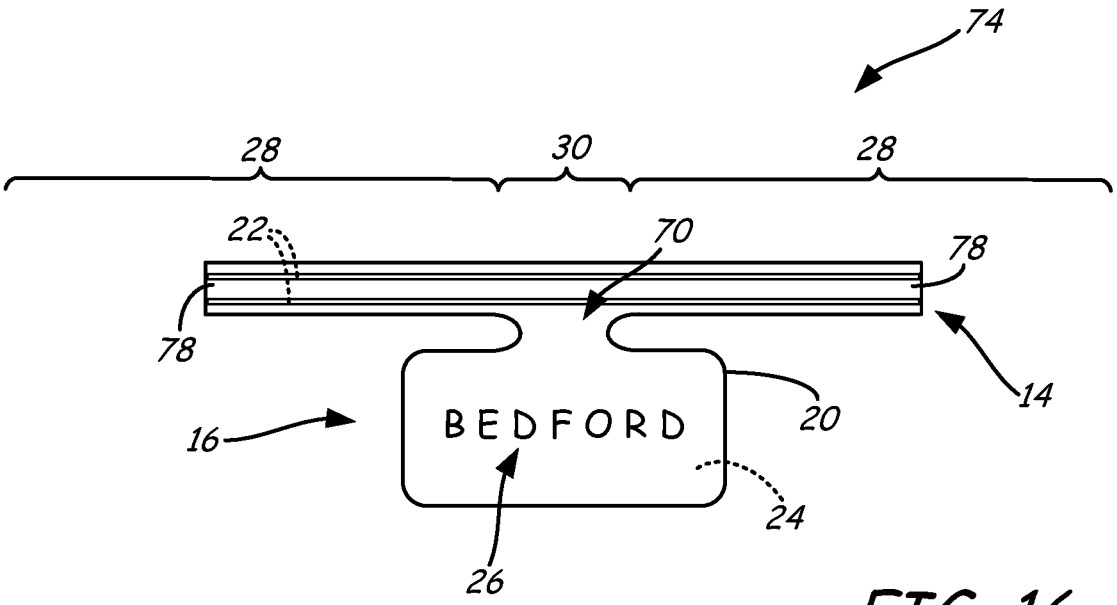
FIG. 16 is a top view of a seventh alternative tie article of the present disclosure, illustrating a tie or attachment portion having two retention wires.

FIG. 16 illustrates tie article 74, which is yet another alternative to tie articles 10, 60, 64, 66, 68, and 72 (or a tie article having any desired geometry for bib portion 16). In this embodiment, attachment portion 14 includes a pair of retention wires 22 and may function as a clasp for attaching tie article 74 to an item. In alternative embodiments, attachment portion 14 may include three or more retention wires 22. Tie article 74 is also particularly suitable for closure devices such as tin ties and clasp ties, which may replace retention wires 22, or be used in addition to retention wires 22.

Figure 17:
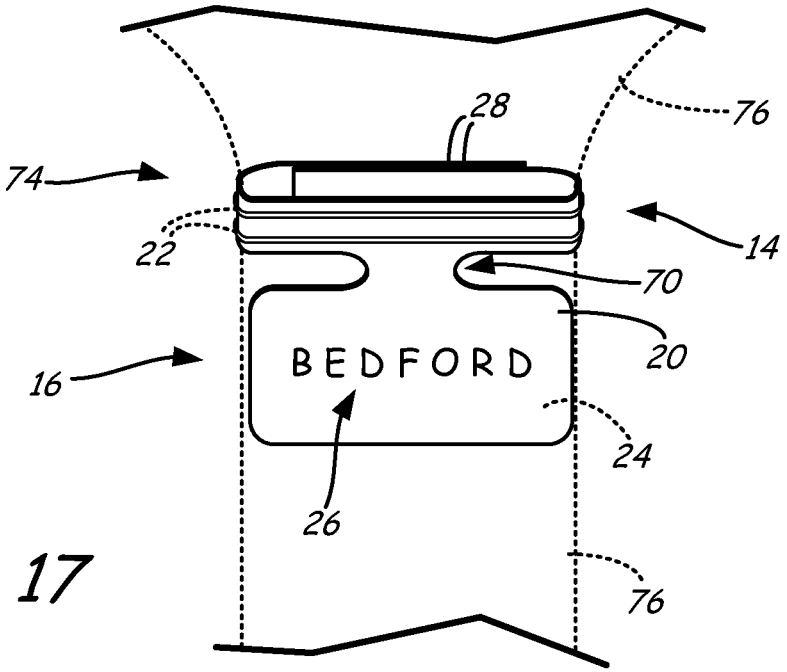
FIG. 17 is a front perspective view of the seventh alternative tie article clasped around an item.

FIG. 17 illustrates tie article 74 attached to item 76 (shown with broken lines). As shown, retention wires 22 allow arm segments 28 of tie or clasp portion 14 to bend around item 76 and fold against each other in a clasped manner. The dead-fold properties of retention wires 22 allow arm segments 28 to remain in their clasped arrangement until a user desires to separate them by pulling arm segments 28 apart. In alternative embodiments, arm segments 28 of attachment portion 14 may be tied together in a twist-tie manner, as discussed above for tie articles 10, 60, 64, 66, 68, and 72. Accordingly, as discussed above, the terms "tie portion" and "tie article" are not intended to limit the use or function of the tie articles of the present disclosure to twist-tie or other tying arrangements, and the tie portions may be used to attach the tie articles to items in a variety of manners, such as with the clasp engagement shown in FIG. 17.

The above-discussed embodiments for tie articles 10, 60, 64, 66, 68, 72, and 74 may be combined with each other as desired to produce tie articles having customized tie portions 14 and bib portions 16. For example, the embodiment of tie article 60, having a film 20 disposed only over tie portion 14 (and/or over a reduced area of bib portion 16) may be used with a bib portion 16 having a customized geometry (e.g., from tie articles 64 and 66), a necked-down region (e.g., from tie article 68), an off-centered location relative to the length of tie portion 14 (e.g., from tie article 72), and/or a multiple-retention wire/clasp arrangement (e.g., tie article 74). Additionally, as discussed above, while described herein with the use of retention wires, in other embodiments, the tie portions may include other polymeric and/or metallic closure devices, such as tin ties, clip ties, and the like, which desirably provide good dead-fold properties, as well as good break resistance.

Furthermore, multiple tie articles of these combined embodiments may be manufactured in sheet form (e.g., sheet 56, shown above in FIG. 6) with a continuous, in-line process (e.g., with process system 36, shown above in FIG. 5). During use, each individual tie article may be separated from the continuous sheet, and the tie portion 14 thereof may be used to attach the tie article to an item, to bundle items together (e.g., agricultural produce, closable packages, cables, writing utensils, eating utensils, and the like), and/or to hold packages and articles closed (e.g., hold bread bags closed or rolled paper closed). The corresponding bib portion 16 may then prominently display information, such as textual, graphical, colored, machine readable information, and/or internet addresses about the attached or bundled items.

Although the present disclosure has been described with reference to several embodiments, workers skilled in the art will recognize that changes may be made in form and detail without departing from the spirit and scope of the disclosure.

The invention claimed is:

1. An in-line process for manufacturing tie articles, the in-line process including:

feeding a printed sheet of a paper-based material to a nip roller, wherein the printed sheet includes printed information;

feeding a plurality of closure devices to the nip roller with the fed printed sheet;

feeding an extruded polymeric material to the nip roller in contact with the printed information of the fed printed sheet and in contact with the fed closure devices;

forming a tie article sheet from the fed printed sheet, the fed closure devices, and the fed polymeric material such that the closure devices are encased between the printed sheet and the polymeric material; and cutting the tie article sheet into a plurality of tie articles, at least some of the plurality of tie articles remaining partially connected to each other, at least one of the plurality of tie articles having:

an attachment portion with a first part of the fed polymeric material, a part of at least one of the plurality of closure devices, and a first part of the fed printed sheet; and a bib portion extending from the attachment portion and including a second part of the fed polymeric material and a second part of the fed printed sheet with the printed information.

2. The in-line process of claim 1, wherein cutting the tie article sheet into the plurality of tie articles includes cutting the at least one of the plurality of closure devices between adjacent tie articles.

3. The in-line process of claim 1, wherein at least some of the plurality of tie articles are in a staggered back-to-back arrangement.

4. The in-line process of claim 1, wherein the second part of the fed polymeric material is adhered to the printed sheet at the bib portion such that the printed information is visible through the second part of the fed polymeric material.

5. The in-line process of claim 1, wherein at least some of the plurality of tie articles include parts of two of the plurality of closure devices per attachment portion.

6. A process for manufacturing a plurality of tie articles, the process including:

feeding a first web of a first material in a first direction;

feeding a first wire adjacent the first web in the first direction;

feeding a second web of a second material in the first direction, wherein the first web and the second web encase the fed first wire;

laminating the first web and the second web with the first wire therebetween to form a tie article web; and cutting the tie article web to form a plurality of connected tie articles, at least one of the connected tie articles including:

an attachment portion including a first portion of the first web, a portion of the first wire, and a first portion of the second web; the attachment portion including a first arm and a second arm; and a bib portion extending from the attachment portion and being configured to bear indicia, the bib portion including a second portion of the first web and a second portion of the second web.

7. The process of claim 6 further including extruding a polymer to form the second web.

8. The process of claim 6 wherein the laminating is accomplished by one or more nip rollers.

9. The process of claim 6 further including printing the indicia on the first web.

10. The process of claim 6, wherein the cutting includes cutting the first wire between adjacent tie articles.

11. The process of claim 6, wherein at least two of the plurality of connected tie articles have bib portions that are aligned with each other in the first direction.

12. The process of claim 11, wherein:

one of the aligned bib portions bears first indicia; and the other of the aligned bib portions bears second indicia that are upside-down relative to the first indicia.

13. The process of claim 6 wherein the tie article web includes a scrap portion between two adjacent tie articles, the process further including removing the scrap portion from the tie article web.

14. The process of claim 6 further including feeding a second wire between the first web and the second web in the first direction, wherein the cutting includes forming each tie article with the attachment portion including the portion of the first wire and a portion of the second wire.

15. The process of claim 6 further including rolling the tie article web.

16. The process of claim 6 wherein the cutting includes cutting the tie article web into a plurality of sheets.

17. The process of claim 6 further including folding the tie article web.

18. The process of claim 6 further including feeding a third web in the first direction, on an opposite side of the second web than the first web.

19. The process of claim 18 further including extruding a polymer to form the third web.

20. The process of claim 6 wherein the second web does not extend entirely over the bib portion.

* * * * *